US005794369A

United States Patent [19]

Lee et al.

[11] Patent Number: 5,794,369

[45] Date of Patent: Aug. 18, 1998

[54] DEVICE AND PROCESS FOR CONTROLLING THE AUTOMATIC OPERATIONS OF POWER EXCAVATORS

[75] Inventors: Si Cheon Lee, Changwon; Dong Jae Lee, Seoul, both of Rep. of Korea

[73] Assignee: Samsung Heavy Industries, Co., Ltd., Seoul, Rep. of Korea

[21] Appl. No.: 564,761

[22] Filed: Nov. 29, 1995

[51] Int. Cl.[6] ..... E02F 5/02

[52] U.S. Cl. ..... 37/348; 364/424.07; 37/414

[58] Field of Search ..... 37/348, 382, 414; 414/699, 694, 718, 728; 364/424.07; 172/7

[56] References Cited

U.S. PATENT DOCUMENTS

| | | | |
|---|---|---|---|
| 4,377,043 | 3/1983 | Inui et al. | 37/18 R |
| 5,065,326 | 11/1991 | Sahm | 37/348 X |
| 5,116,186 | 5/1992 | Hanamoto et al. | 414/694 |
| 5,178,510 | 1/1993 | Hanamoto et al. | 37/348 X |
| 5,356,259 | 10/1994 | Hanamoto et al. | 37/348 X |
| 5,408,767 | 4/1995 | Hazama et al. | 37/396 |
| 5,438,771 | 8/1995 | Sahm et al. | 37/348 |
| 5,442,868 | 8/1995 | Ahn | 37/348 |
| 5,446,980 | 9/1995 | Rocke | 37/348 |
| 5,446,981 | 9/1995 | Kamada et al. | 37/348 |
| 5,461,803 | 10/1995 | Rocke | 37/443 |
| 5,493,798 | 2/1996 | Rocke et al. | 37/348 |
| 5,497,568 | 3/1996 | Strickland | 37/348 |
| 5,528,843 | 6/1996 | Rocke | 37/348 |
| 5,535,532 | 7/1996 | Fuji et al. | 37/348 |
| 5,553,407 | 9/1996 | Stump | 37/348 |

*Primary Examiner*—Terry Lee Melius
*Assistant Examiner*—Victor Batson
*Attorney, Agent, or Firm*—Kenyon & Kenyon

[57] ABSTRACT

A device and process for controlling the automatic operations of a power excavator are disclosed. The device has a plurality of sensors for sensing the motions of the excavator's moving parts. The device also has a controller with discriminating means. The discriminating means operates the sensed data of the sensors and discriminates the automatic operation to be performed. The controller outputs the control signals to the excavator's moving parts for automatically performed the automatic operation. The control device further includes recognizable signal output means for converting the discriminated results into recognizable signals prior to outputting the discriminated results, and confirmation signal input means for confirming the discriminated results outputted from the recognizable signal output means.

16 Claims, 6 Drawing Sheets

DEVICE AND PROCESS FOR CONTROLLING THE AUTOMATIC OPERATIONS OF POWER EXCAVATORS

BACKGROUND OF THE INVENTION

1. Field of the Invention

The present invention relates in general to a device and process for controlling construction equipment such as power excavators to automatically perform the automatic operations of the construction equipment and, more particularly, to an improvement in the device and process for controlling the power excavators so as to automatically perform the various automatic operations under the control of the controller.

2. Description of the Prior Art

Power excavators are representative construction equipment preferably used for digging. A typical power excavator is shown in FIG. 1. As shown in the drawing, the power excavator has a travelling part 105 and a turret 104. The turret 104 is rotatably mounted to the top of the travelling part 105. The excavator also includes a working member part which is movably mounted to the front of the turret 104. The working member part includes a plurality of working members which are pivoted to each other at the joints. At the joints, the working members are operated by actuators of the cylinder type so as to be turned in, out, up and down, thereby performing the desired operations.

The working members of the power excavator include a boom 101, an arm 102 and a bucket 103, while the turret 104 rotates relative to the travelling part 105 by a swing motor which is a kind of an actuator. However, it is very difficult to individually or compositely handle the control levers of a control cap for delicately controlling the turning motions of the boom 101, arm 102 and bucket 103 and for controlling the swinging motion of the turret 104 relative to the travelling part 105 while performing the desired operations. In this regard, the operators of the power excavators must be highly skilled.

Therefore, it may be preferred to automatically control the power excavators without any lever handling motions of the operator while the excavators perform the specific operations. The automatic control is particularly profitable when the excavator performs the operations in which the working members repeat the similar motions several times. The automatic control technology for automatically controlling the operations of the power excavators has been actively studied and developed recently and is in the early stages of being used practically.

For example, the automatic land finishing operations, the operations accompanied by the bucket angle maintaining function, the operations accompanied by the dumping rate adjusting function and the operations accompanied by the automatically vibrating function are the representative operations of the power excavators suitable to be automatically controlled.

It is required to continuously detect both data of the swinging angles of the turret 104 relative to the travelling part 105 and data of the turning angles of the working members when automatically controlling the power excavator while performing the above automatic operations. In order to achieve the above object, the control device of the power excavator typically includes a boom angle sensor 1, an arm angle sensor 2, a bucket angle sensor 3 and a swing sensor 4 as shown in FIG. 1. The boom angle sensor 1 senses the turning angles of the boom 101 relative to the turret 104.

The arm angle sensor 2 senses the turning angles of the arm 102 relative to the boom 101. The bucket angle sensor 3 senses the turning angles of the bucket 103 relative to the arm 102. The swing sensor 4 senses the swinging angles of the turret 104 relative to the travelling part 105.

FIG. 6 is a block diagram showing the construction of a typical device for automatically controlling the desired operations of the power excavator. In order to perform the desired operation of the excavator using the typical control device, the operator handles the control levers known as the joysticks. The control levers thus output the lever signals indicative of the lever handling motions to a controller. The controller stores several programs for automatically performing the automatic operations. Upon receiving the above lever signals, the controller outputs the control signals corresponding to the lever signals to an electromagnetic proportional control valve. Upon receiving the control signals of the controller, the electromagnetic proportional control valve generates pilot pressure which operates a main control valve (MCV) for operating the working members. If briefly described, the automatic operations of the power excavators are automatically performed under the control of the controlled. The controller outputs the control signals to the electro-magnetic proportional control valve In response to input signal and in accordance with the preset programs stored In the controller thereby performing the automatic operations. The input signals applied to the controller include the lever signals outputted from the control levers and the function select signals outputted from an automatic function select switch.

In order to change the operation of the excavator to another automatic operation, the operator pushes the desired function select button during the previous operation. The desired automatic operation start signal is thus applied to the controller for performing the desired automatic operation. For example. If the operator wants to change the operation of the excavator from the automatic operation accompanied by the bucket angle maintaining function to the automatic land finishing operation, the bucket angle maintaining function should be canceled prior to pushing the automatic land finishing operation select button. After pushing the operation select button, the excavator stands at the initial position for performing the automatic land fishing operation. After standing the excavator at the initial position. the operation start signal is applied to the controller so as to start the automatic land finishing operation.

That is, the operator stops the previous operation and pushes the desired function select button every time the operation of the excavator is changed from one automatic operation to another automatic operation. However, this is inconvenient to the operator and substantially reduces the operational efficiency of the excavator which performs the automatic operations. In addition, the typical control device has the plurality of function select buttons for selecting the different functions. However, the function select buttons increase the cost of the control devices and complicate the outer appearance of the control panel, thereby confusing the operator.

SUMMARY OF THE INVENTION

It is, therefore, an object of the present Invention to provide a device and process for controlling the automatic operations of a power excavator in which the above problems can be overcome and which remarkably improve the operational efficiency of the operators.

It is another object of the present Invention to provide a device and process for controlling the automatic operations of a power excavator which easily and directly change the automatic operation of the excavator to another automatic operation without needing to stop the previous operation.

It is a further object of the present Invention to provide a device and process for controlling the automatic operations of a power excavator which are convenient to the operators during the automatic operations.

It is yet another object of the present Invention to provide a device and process for controlling the automatic operations of a power excavator which simplify the construction of the control device and the outer appearance of the control panel, thereby reducing the cost of the control device.

In an aspect, the present invention provides a device for controlling the automatic operations of a power excavator comprising sensing means adapted for sensing the motions of moving parts of the excavator, discriminating means adapted for operating sensed data outputted from the sensing means and discriminating the automatic operation to be performed by the excavator, and control signal output means adapted for outputting control signals to the moving parts of the excavator so as to automatically perform the automatic operation discriminated by the discriminating means.

In another aspect, the present invention provides a process for controlling the automatic operations of a power excavator comprising the steps of sensing the motions of moving parts of the excavator, operating sensed data of the above sensing step and thereby discriminating the automatic operation to be performed by the excavator, and outputting control signals to the moving parts of the excavator so as to automatically perform the automatic operation discriminated at the above discriminating step.

In accordance with a preferred embodiment of the present invention, the control device further comprises recognizable signal output means for converting the discriminated results of the discriminating means into recognizable signals suitable to be recognized by the operator prior to outputting the discriminated results, and confirmation signal input means for confirming the discriminated results outputted from the recognizable signal output means. In the above case, the control process further comprises the steps of converting the discriminated results of the discriminating step into recognizable signals suitable to be recognized by the operator prior to outputting the discriminated results, and confirming the discriminated results outputted at the recognizable signal outputting step.

BRIEF DESCRIPTION OF THE DRAWINGS

The above and other objects, features and other advantages of the present invention will be more clearly understood from the following detailed description taken conjunction with the accompanying drawing, in which:

FIGS. 2A to 2C are views showing the different automatic operations performed by the power excavator provided with the automatic control device In accordance with the present invention, in which:

FIG. 2A shows the power excavator during the automatic land finishing operation.

FIG. 2B shows the power excavator during the automatic land finishing operation accompanied by the bucket angle maintaining function: and FIG. 2C hows the power excavator for representing the bucket angle maintaining function:

DESCRIPTION OF THE PREFERRED EMBODIMENTS

Figure 3:
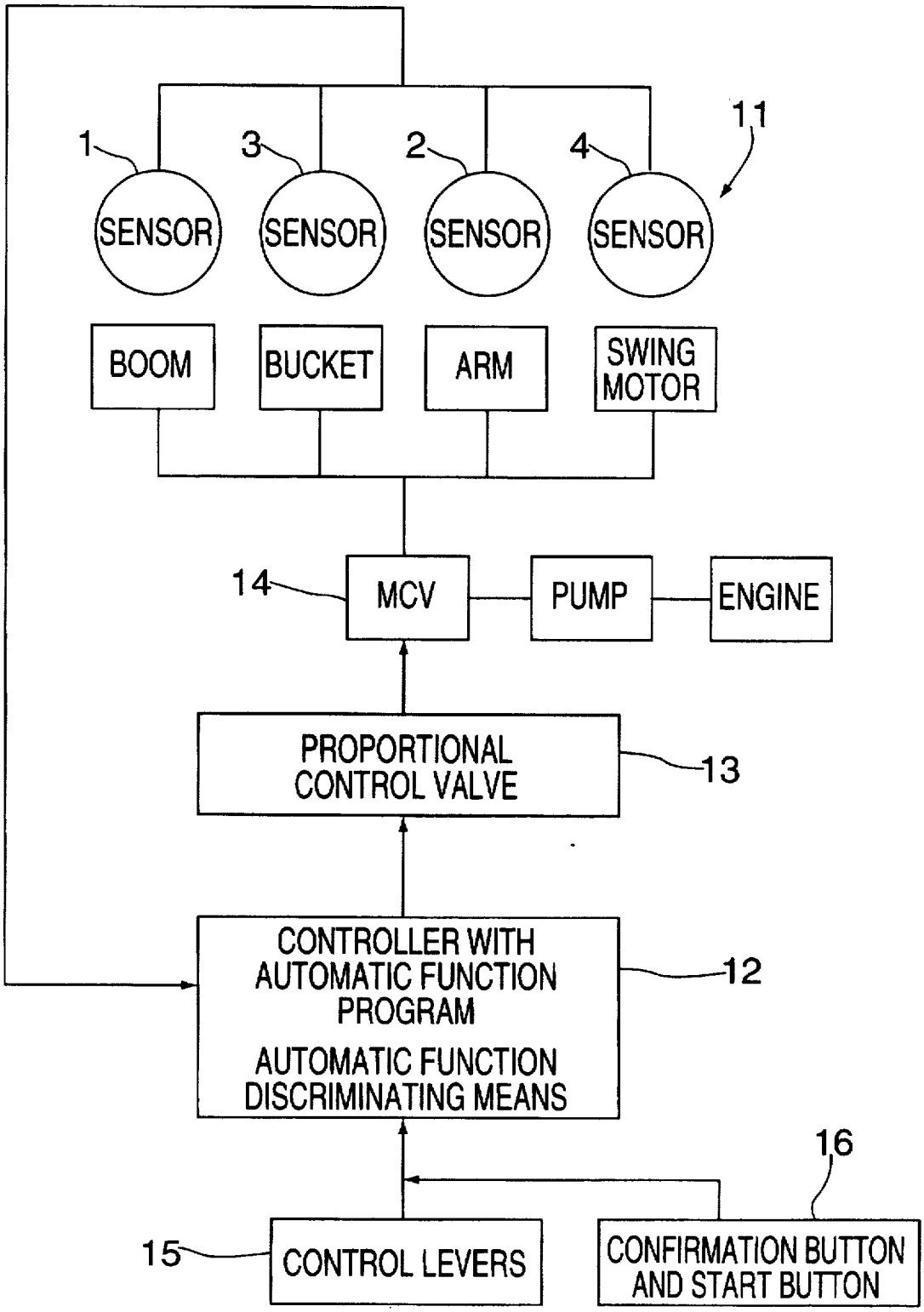
FIG. 3 is a block diagram schematically showing the construction of the power excavator with the control device of the present Invention.

FIG. 3 is a block diagram schematically showing the construction of the power excavator with the control device of the present invention.

As shown in FIG. 3, the control device of this invention includes sensing means 11 for sensing the motions of the excavator. The sensing means 11 includes a plurality of sensors, that is, a boom angle sensor 1, an arm angle sensor 2, a bucket angle sensor 3 and a swing sensor 4. The boom angle sensor 1 senses the turning angles of the boom relative to the turret. The arm angle sensor 2 senses the turning angles of the arm relative to the boom. The bucket angle sensor 3 senses the turning angles of the bucket relative to the arm. The swing sensor 4 senses the swinging angles of the turret relative to the travelling part.

The control device also includes a controller 12. The above controller 12 has a discriminating means for operating the data outputted from the above sensors 1, 2, 3 and 4 and discriminating the desired automatic operation selected by the operator. The controller 12 outputs a control signal to an electromagnetic proportional control valve 13 in accordance with the discriminated results of the above discriminating means. Upon receiving the control signals, the electromagnetic proportional control valve 13 generates pilot pressure which operates a main control valve (MCV) 14. The main control valve thus operates the moving parts of the excavator. The moving parts of the excavator includes a plurality of working members and the turret. The working members include the boom, arm and bucket which are operated by actuators, while the turret is swung relative to the travelling part by a swing motor.

Of course, the working members and the turret of the excavator of this invention also may be manually operated by handling the control levers by the operator in the conventional manner.

The control device of this invention preferably includes a recognizable signal output means and a confirmation signal input means 16. In accordance with the determined results of the controller 12, the recognizable signal output means converts the signals indicative of the operations selected by the operator into recognizable signals suitable to be recognized by the operator prior to outputting the signals to a lamp means. The confirmation signal input means 16 allows the operator to input a confirmation signal for confirming the selected automatic operation after seeing the signals outputted from the recognizable signal output means. In this case, the controller determines in accordance with the signal of the confirmation signal input means 16 whether the discriminated automatic operation starts.

Hereinbelow, both the above recognizable signal output means and the confirmation signal input means 16 will be described in detail.

If the controller receives the signals outputted from the sensing means and determines that the excavator is waiting to perform, for example, the automatic land finishing operation, a green lamp flickers so as to request the operator to confirm the automatic land finishing operation. It is preferred to install the above green lamp in a place where the operator can easily view it. When the operator pushes an automatic operation select confirmation button for confirming the automatic land finishing operation, the green lamp continuously stays on to inform the operator of selecting the automatic land finishing operation. In this case, the above confirmation button is preferably designed to be automatically held in its pushed state when the pushing force is removed from the button after the button is pushed by the operator. The above green lamp continuously stays on while the confirmation button is held in the pushed state. The excavator starts the selected automatic operation when an automatic operation start button is pushed while the green lamp is continuously showing on. A red lamp flickers while the above start button is being pushed, thereby informing the operator of the selected automatic operation being performed by the excavator. The above start button does not have any holding functions, so that the start button should be continuously pushed so as to continue the selected automatic operation. When the confirmation button is held in its pushed state after the pushing force removes from the start button, the green lamp continuously stays on. In the above case, the just performed automatic operation will be repeated when the start button is pushed again while the green lamp is continuously showing on as described above. Meanwhile, the green lamp will be turned off to cancel the selected automatic operation if the operator pushes the confirmation button again.

The process performed by the discriminating means of the above controller for determining which automatic operation was selected by the operator will be described hereinbelow.

Figure 1:
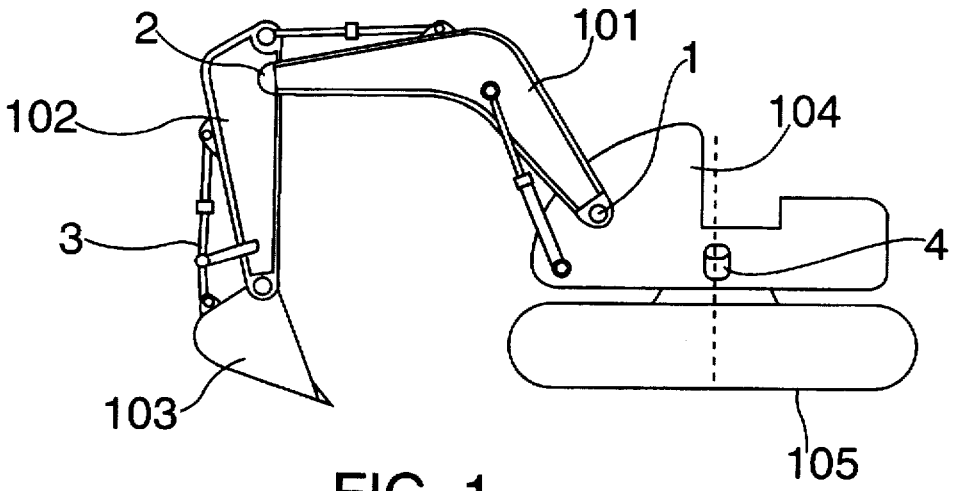
FIG. 1 is a view showing the construction of a typical power excavator.
Figure 2A:
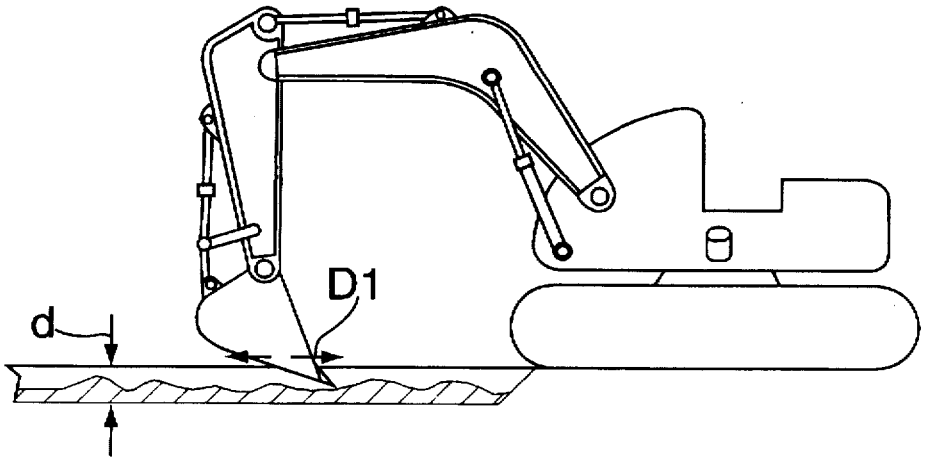
Figure 2B:
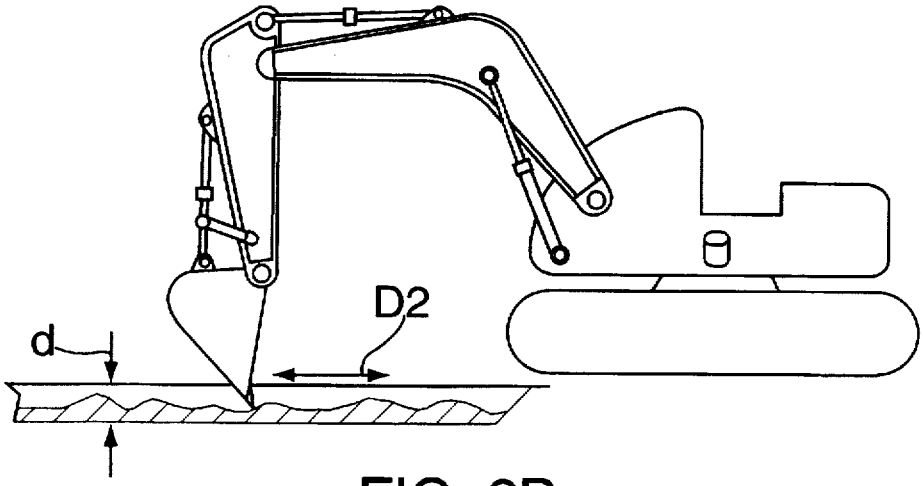

When the operator wants to perform the automatic land finishing operation while the excavator performs the digging operation as shown in FIG. 2A, the operator places the working members, that is, the boom, arm and bucket, at their initial positions suitable to start the automatic land finishing operation. Thereafter, the operator operates the working members in the direction D1 of FIG. 2A. The direction D11 is referred to as "bucket angle direction". If the working members in the above state initially move either by a distance of about 30 cm or for 1 or 2 seconds within the range of allowable error "d" in the direction D1, the discriminating means of the controller determines that the selected operation of the excavator is the automatic land finishing operation. Meanwhile, the discriminating means of the controller also may determine that the selected operation of the excavator is the automatic land finishing operation if the working members initially move either by the distance of about 30 cm or for 1 or 2 seconds within the range of allowable error "d" in the direction D2 instead of the direction D1 as shown in FIG. 2B.

The direction D2 is referred to as "bucket tip direction".

Figure 2C:
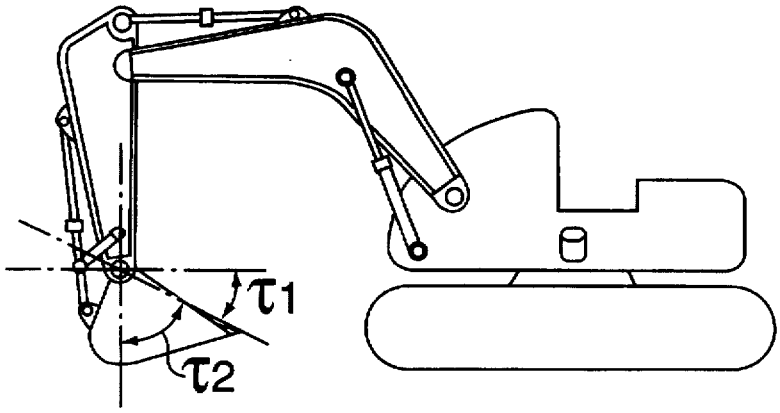

When the operator selects the automatic operation which will be performed while maintaining the bucket angle, the absolute bucket angle $\tau 1$ relative to the reference horizontal line maintains within a predetermined range as shown in FIG. 2C. In the above case, one or both the boom and arm are continuously operated for a predetermined time. The discriminating means of the controller determines that the selected operation is the operation which is to be performed while maintaining the bucket angle. Meanwhile, the discriminating means of the controller determines that the selected operation is the operation which is to be performed while maintaining the bucket angle if the angle $\tau 2$ of the bucket relative to the arm exceeds a predetermined limit while one or both the boom and arm are continuously operated for the predetermined time.

Of course, it is necessary to note that the above processes for determining the automatic land finishing operation and the automatic operation performed while maintaining the bucket angle have been described in connection with a preferred embodiment of the invention. It will be understood that we do not intend to limit the control process of this invention to those processes. That is, the control process of this invention also may be used for various processes when the program of the controller is somewhat modified.

The process for controlling the automatic operations of the power excavator in accordance with the present invention will be described In detail hereinbelow with reference to FIGS. 4 and 5.

Figure 4:
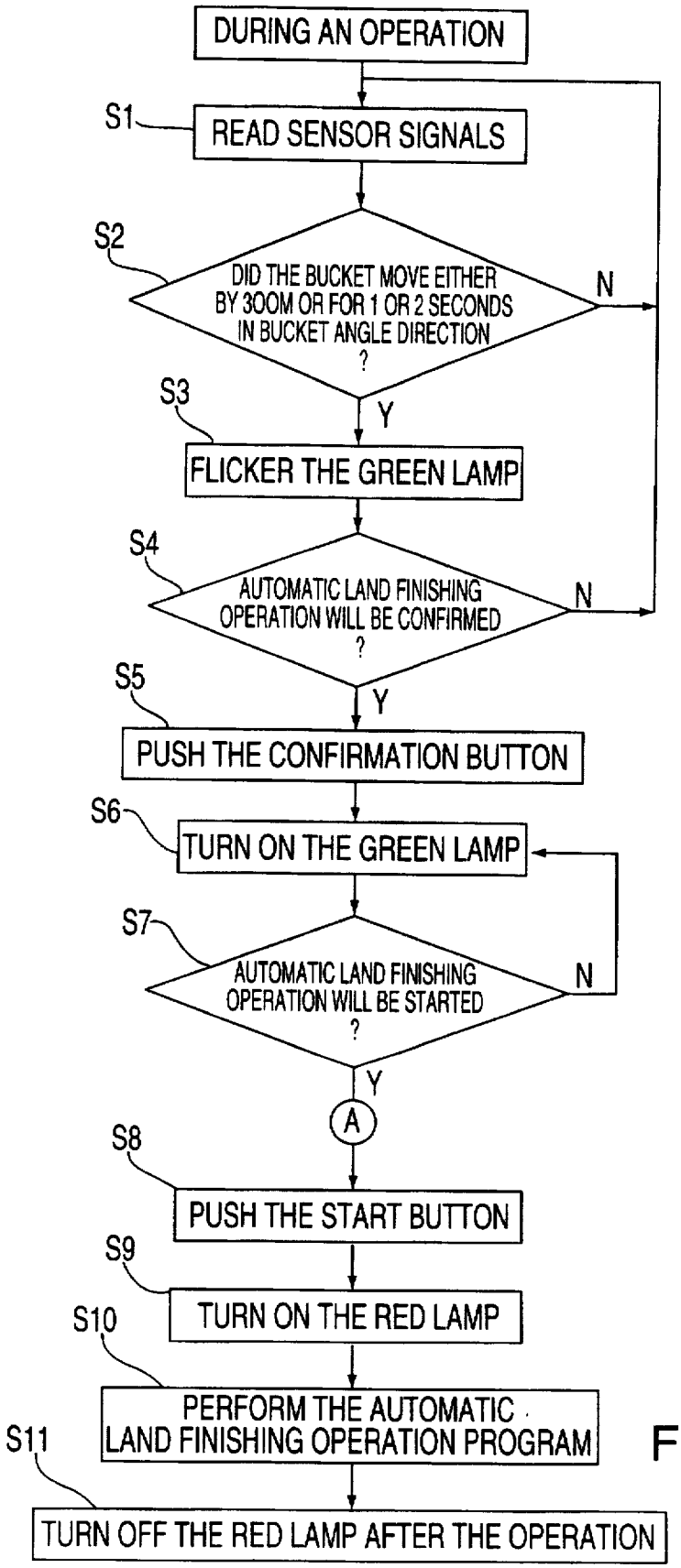
FIG. 4 is a flowchart of the process for controlling the automatic land finishing operation of the power excavator in accordance with the present invention.

FIG. 4 is a flowchart of the process for controlling the automatic land finishing operation of the power excavator in accordance with an embodiment of the present invention.

During the digging operation of the power excavator, the boom angle sensor mounted to the boom senses the angles of the boom relative to the turret. In the same manner, the arm angle sensor mounted to the arm senses the angles of the arm relative to the boom, while the bucket angle sensor mounted to the bucket senses the angles of the bucket relative to the arm (step 1).

The above sensors in turn output the signals indicative of the sensed angles of the working members to the controller. Upon receiving the signals of the sensors, the discriminating means of the controller checks whether the working members initially moved either by the distance of about 30 cm or for 1 or 2 seconds within the range of allowable error "d" in the bucket angle direction D1. That is, the discriminating means checks whether the working members of the excavator moved in accordance with the target values of the preset program stored in the controller (step 2).

When the answer of step 2 is no, the controller repeats step 1 to sense the motions of the working members. However, when the answer of step 2 is yes, the green lamp installed in the place easily observed by the operator's eyes flickers so as to inform the operator of the checked results that the operation is the automatic land finishing operation (step 3). The flickering green lamp also requests the operator to confirm the automatic land finishing operation (step 4).

If the operator doesn't confirm the automatic land finishing operation at step 4, the controller repeats step 1 to sense the motions of the working members. The operator pushes the automatic function select confirmation button to confirm the automatic land finishing operation (step 5). The above confirmation button may be installed in the left-handed control lever.

When the operator pushes the automatic function select confirmation button at step 5, the green lamp continuously stays on thereby informing the operator of selecting the automatic land finishing operation (step 6).

After the operator recognizes the selected automatic land finishing operation at step 6, the operator determines whether the selected automatic land finishing operation will be practically performed or not (step 7).

When the operator doesn't confirm the automatic land finishing operation at step 7, the controller repeats step 6 to wait for the next order of the operator. Meanwhile, the operator pushes the automatic function start button to start the selected land finishing operation practically (step 8). The above start button may be installed in the right-handed control lever.

When the operator pushes the automatic function start button at step 8, the red lamp continuously stays on thereby informing the operator of performing the automatic land finishing operation (step 9). During the above automatic land finishing operation, both the turning motions of the working members and the swinging motion of the swing motor are automatically controlled by the automatic land finishing operation performing program stored in the controller (step 10).

After the excavator finishes the automatic land finishing operation, the red lamp is turned off.

Figure 5:
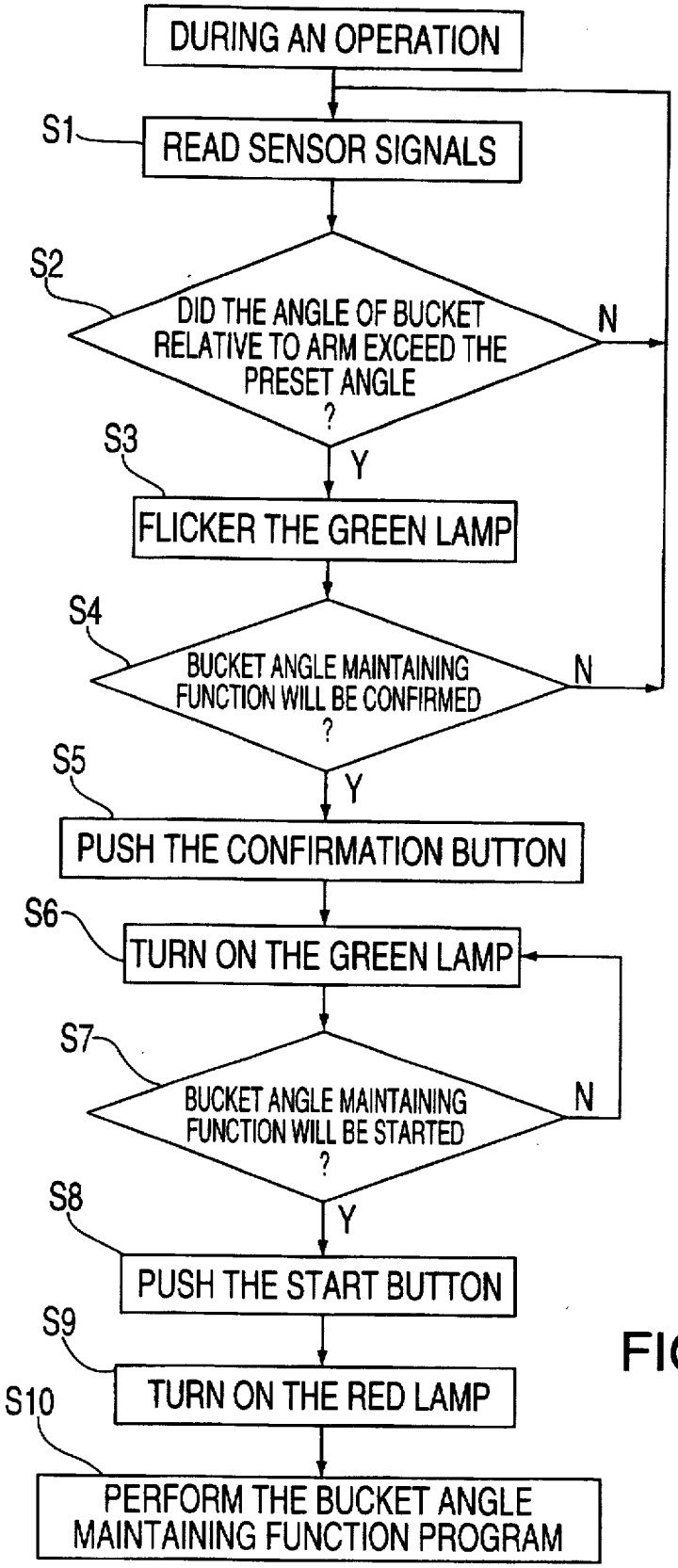
FIG. 5 is a flowchart of the process for maintaining the bucket angle of the power excavator in accordance with the present invention.
Figure 6:
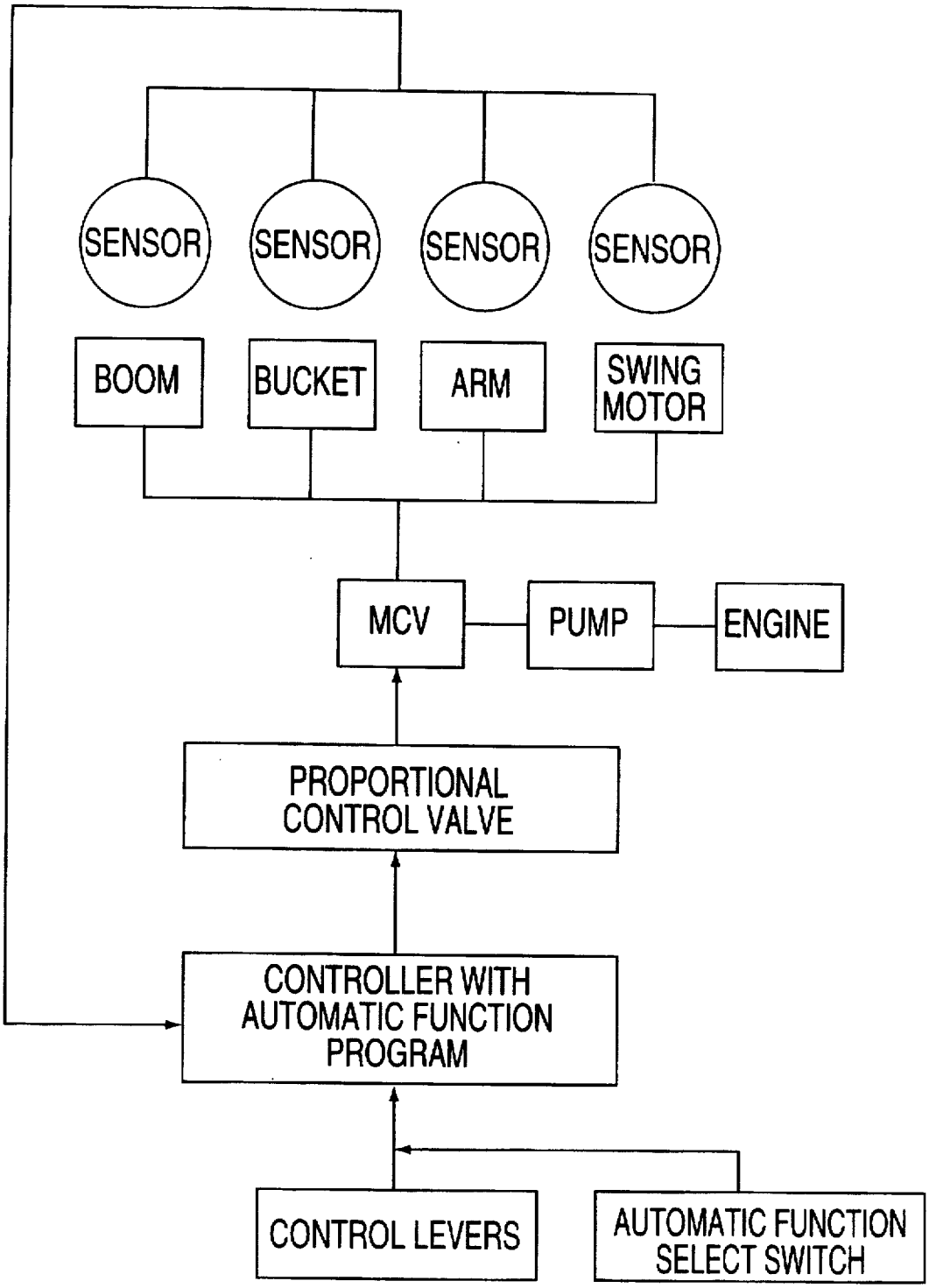
FIG. 6 is a block diagram schematically showing the construction of the power excavator with the typical control device.

FIG. 5 is a flowchart of the process for controlling the automatic operation performed while maintaining the bucket angle in accordance with another embodiment of the present invention.

During the digging operation of the power excavator, the boom angle sensor mounted to the boom senses the angles of the boom relative to the turret. In the same manner, the arm angle sensor mounted to the arm senses the angles of the arm relative to the boom, while the bucket angle sensor mounted to the bucket senses the angles of the bucket relative to the arm (step 1).

The above sensors in turn output the signals indicative of the sensed angles of the working members to the controller. Upon receiving the signals of the sensors, the discriminating means of the controller checks whether the angle of the bucket relative to the arm exceeds the preset value. That is, the discriminating means checks whether the working members of the excavator moved in accordance with the target values of the preset program stored in the controller (step 2).

When the answer of step 2 is no, the controller repeats step 1 to sense the motions of the working members. However, when the answer of step 2 is yes, the green lamp which is installed in the place where the operator can easily see it flickers so as to inform the operator of the checked results that the operation is the automatic operation to be performed while maintaining the bucket angle (step 3). The flickering green lamp also requests the operator to confirm the above automatic operation (step 4).

If the operator doesn't confirm the above automatic operation accompanied by the bucket angle maintaining function at step 4, the controller repeats step 1 to sense the motions of the working members. Meanwhile, the operator pushes the automatic function select confirmation button to confirm the above automatic operation accompanied by the bucket angle maintaining function (step 5). The above confirmation button may be installed in the left-handed control lever.

When the operator pushes the automatic function select confirmation button at step 5, the green lamp continuously stays on thereby informing the operator of selecting the automatic operation accompanied by the bucket angle maintaining function (step 6).

After the operator recognizes the selected automatic operation Accompanied by the bucket angle maintaining function at step 6, the operator determines whether the selected automatic operation will be practically performed or not (step 7).

When the operator doesn't confirm the automatic operation accompanied by the bucket angle maintaining function at step 7, the controller repeats step 6 to wait for the next order of the operator. Meanwhile, the operator pushes the automatic function start button to start the selected operation practically (step 8). The above start button may be installed in the right-handed control lever.

When the operator pushes the automatic function start button at step 8, the red lamp continuously stays on thereby informing the operator of performing the selected automatic operation accompanied by the bucket angle maintaining function (step 9). During the automatic operation, both the turning motions of the working members and the swinging motion of the swing motor are automatically controlled by the bucket angle maintaining function performing program stored in the controller (step 10).

Please note that the processes for controlling the above-mentioned automatic operations are the preferred embodiments of the control process of this invention. It may be possible to remove several steps from the above processes for performing the automatic operations. For example, the operation checked by the controller may be directly started without any steps for confirming the operation. In addition, the construction of both the signal lamps, that is, the green and red lamps, and the buttons, that is, the confirmation and start buttons installed in the left and right-handed control levers, may be changed and modified by those skilled in the art.

As described above, the present invention provides an improved device and process for automatically controlling the automatic operations of the power excavators. In accordance with the control device and process of this invention, both the turning motions of the working members and the swinging motion of the turret are sensed by the sensors thereby allowing the operator to check which automatic operation will be performed. After checking the automatic operation to be performed, both the turning motions of the working members and the swinging motion of the turret are automatically controlled in accordance with the checked results. Therefore, the control device and process of the present invention remarkably improve the operational efficiency of the operator. The device and process of this invention also make it possible to change the operation of the excavator without needing to stop the excavator. Furthermore, the invention simplifies the construction of the control device thereby reducing the cost of the control devices of the power excavators.

What is claimed is:

1. A device for controlling automatic operations of a power excavator comprising:

sensing means adapted for sensing the motions of moving parts of said excavator;

discriminating means adapted for operating sensed data outputted from the sensing means and discriminating, without reference to an operator input, the automatic operation to be performed by the excavator; and control signal output means adapted for outputting control signals to said moving parts of the excavator so as to automatically perform the automatic operation discriminated by the discriminating means.

2. A device for controlling automatic operations of a power excavator comprising:

sensing means adapted for sensing the motions of moving parts of said excavator;

discriminating means adapted for operating sensed data outputted from the sensing means and discriminating the automatic operation to be performed by the excavator;

control signal output means adapted for outputting control signals to said moving parts of the excavator so as to automatically perform the automatic operation discriminated by the discriminating means; and recognizable signal output means for converting discriminated results of said discriminating means into recognizable signals suitable to be recognized by an operator prior to outputting said discriminated results.

3. The control device according to claim 2, wherein said device further comprises confirmation signal input means for allowing the operator to confirm the recognizable signals representative of the discriminated results outputted from the recognizable signal output means, and said control signal output means is operated in accordance with an input signal of said confirmation signal input means.

4. A device for controlling automatic operations of a power excavator comprising:

sensing means adapted for sensing the motions of moving parts of said excavator;

discriminating means adapted for operating sensed data outputted from the sensing means and discriminating the automatic operation to be performed by the excavator; and control signal output means adapted for outputting control signals to said moving parts of the excavator so as to automatically perform the automatic operation discriminated by the discriminating means;

wherein said sensing means includes at least a swing sensor for sensing swinging angles of a turret relative to a travelling part of the excavator, a boom angle sensor for sensing turning angles of a boom relative to said turret, an arm angle sensor for sensing turning angles of an arm relative to said boom, and a bucket angle sensor for sensing turning angles of a bucket relative to said arm.

5. The control device according to claim 4, wherein said discriminating means determines that the automatic operation to be performed by the excavator is an automatic land finishing operation when said bucket moves by a predetermined distance within the range of an allowable error in a bucket angle direction.

6. The control device according to claim 4, wherein said discriminating means determines that the automatic operation to be performed by the excavator is an automatic land finishing operation when said bucket moves for a predetermined time within the range of allowable error in a bucket angle direction.

7. The control device according to claim 4, wherein said discriminating means determines that the automatic operation to be performed by the excavator is an automatic operation accompanied by a bucket angle maintaining function when not only the absolute angle of said bucket relative to a reference horizontal line is maintained within a predetermined angular range, but also one or both said boom and arm continuously move for a predetermined time.

8. The control device according to claim 4, wherein said discriminating means determines that the automatic operation to be performed by the excavator is an automatic operation accompanied by a bucket angle maintaining function when not only the angle of said bucket relative to said arm exceeds a predetermined limit angle, but also one or both said boom and arm continuously move for a predetermined time.

9. A process for controlling automatic operations of a power excavator comprising the steps of:

sensing the motions of moving parts of said excavator;

operating sensed data of the above sensing step and discriminating, without reference to an operator input, the automatic operation to be performed by the excavator; and outputting control signals to said moving parts of the excavator so as to automatically perform the automatic operation discriminated at the above discriminating step.

10. A process for controlling automatic operations of a power excavator comprising the steps of:

sensing the motions of moving parts of said excavator;

operating sensed data of the above sensing step and discriminating the automatic operation to be performed by the excavator;

outputting control signals to said moving parts of the excavator so as to automatically perform the automatic operation discriminated at the above discriminating step; and converting discriminated results of said discriminating step into recognizable signals suitable to be recognized by an operator prior to outputting said discriminated results.

11. The control process according to claim 10, wherein said process further comprises the step of confirming the discriminated results outputted at the recognizable signal outputting step, and said control signal outputting step is performed in accordance with a signal inputted at said confirming step.

12. A process for controlling automatic operations of a power excavator comprising the steps of:

sensing the motions of moving parts of said excavator;

operating sensed data of the above sensing step and discriminating the automatic operation to be performed by the excavator; and outputting control signals to said moving parts of the excavator so as to automatically perform the automatic operation discriminated at the above discriminating step;

wherein said sensing step includes at least the steps of sensing swinging angles of a turret relative to a travelling part of the excavator, sensing turning angles of a boom relative to said turret, sensing turning angles of an arm relative to said boom, and sensing turning angles of a bucket relative to said arm.

13. The control process according to claim 12, wherein it is determined at said discriminating step that the automatic operation to be performed by the excavator is an automatic land finishing operation when said bucket moves by a predetermined distance within the range of allowable error in a bucket angle direction.

14. The control process according to claim 12, wherein it is determined at said discriminating step that the automatic operation to be performed by the excavator is an automatic land finishing operation when said bucket moves for a predetermined time within the range of allowable error in a bucket angle direction.

15. The control process according to claim 12, wherein it is determined at said discriminating step that the automatic operation to be performed by the excavator is an automatic operation accompanied by a bucket angle maintaining function when not only the absolute angle of said bucket relative to a reference horizontal line is maintained within a predetermined angular range, but also one or both said boom and arm continuously move for a predetermined time.

16. The control process according to claim 12, wherein it is determined at said discriminating step that the automatic operation to be performed by the excavator is an automatic operation accompanied by a bucket angle maintaining function when not only the angle of said bucket relative to said arm exceeds a predetermined limit angle, but also one or both said boom and arm continuously move for a predetermined time.

* * * * *